US006571407B1

(12) United States Patent
Skarie

(10) Patent No.: US 6,571,407 B1
(45) Date of Patent: Jun. 3, 2003

(54) FAUCET RETAINERS

(76) Inventor: Loren Skarie, 45223 Lone Pine Rd., Vergas, MN (US) 56587

( * ) Notice: Subject to any disclaimer, the term of this patent is extended or adjusted under 35 U.S.C. 154(b) by 0 days.

(21) Appl. No.: 09/811,029

(22) Filed: Mar. 16, 2001

(51) Int. Cl.[7] ..... E03C 1/042
(52) U.S. Cl. ..... 4/695; 137/359; 137/801; 248/231.31
(58) Field of Search ..... 4/695, 675–678; 137/359, 360, 801; 248/222.11, 222.13, 229.11, 229.12, 231.21, 231.31, 231.41

(56) References Cited

U.S. PATENT DOCUMENTS 3,427,049 A * 2/1969 Politz ..... 4/695
4,186,761 A * 2/1980 Guarnieri
4,281,857 A * 8/1981 Randall ..... 4/695
5,465,749 A * 11/1995 Sauter et al.
5,515,882 A * 5/1996 Hennis
5,946,746 A * 9/1999 Bloom ..... 4/675
6,085,784 A * 7/2000 Bloom et al.
6,301,728 B1 * 10/2001 Pilatowicz et al.
6,314,593 B1 * 11/2001 Mantel ..... 4/695
6,370,712 B1 * 4/2002 Burns et al. ..... 4/675
6,385,798 B1 * 5/2002 Burns et al.
6,405,749 B1 * 6/2002 Bloom et al.

FOREIGN PATENT DOCUMENTS

EP 547477 A1 * 6/1993 ..... 4/695

* cited by examiner

*Primary Examiner*—Charles R. Eloshway
(74) *Attorney, Agent, or Firm*—D L Tschida

(57) ABSTRACT

Spring biased retainers that are secured to a faucet base and provide gripping surfaces to engage and draw the faucet into engagement with a sink. Resilient retainer members flex to permit mounting and are normally biased to return to a retention position. In one retainer, tapered gripper and retractor pieces are axially biased for reciprocating movement in a housing. Springs fitted to the gripper and retractor pieces direct movement along cooperating inclined surfaces. Another retainer provides pivoting gripper pieces that are biased in repelling relation and have contoured gripping surfaces. Another retainer provides at least one deformable, resilient leaf spring arm that is biased in repulsion to another arm. Each arm has a contoured gripping surface that engages the sink and secures the faucet. Tapered wedging posts can be mounted to a faucet to cooperate with the spring-biased retainers.

21 Claims, 8 Drawing Sheets

FAUCET RETAINERS

BACKGROUND OF THE INVENTION

The present invention relates to water faucets and, in particular, to a quick-disconnect faucet including a number of alternative resilient, spring-biased retainers adapted to a faucet base to self-attach the faucet to a plumbing fixture such as a sink.

If one believes the installation instructions that come with most water faucets, the installation of the faucets for kitchen and bath sinks can be a relatively simple task. In practice, however, the theory is complicated by the cramped and limited workspace that is available to the plumber and home-handymen. The water supply lines, sink and kitchen or bath cabinet walls hamper access. The necessity to work on one's back and without adequate light in the available space adjacent the sink bottom exacerbates the difficulties. Some special tools are available to assist the installer with necessary fasteners, but frequently, it is still necessary to blindly manipulate the tools from inconvenient body positions.

Many conventional faucets provide threaded supply lines that contain oversized washers and nuts. The faucet is secured to the sink by drawing the nuts tight to the sink bottom, which draws the faucet into compression with the sink top and any sealing mechanism placed between the faucet and sink top. Some faucets provide threaded stems that cooperate with flanged wings that grip the sink bottom.

A variety of faucet assemblies with quick-disconnect retainers have also been developed to facilitate faucet repair and replacement. Some of faucets including fastener assemblies adapted to threaded members are shown at U.S. Pat. Nos. 6,085,784; 5,946,746; 5,465,749; and 4,281,857. U.S. Pat. No. 4,553,277 discloses a hydraulically controlled clamp. U.S. Pat. No. 4,186,761 discloses a spring-biased fastener having a "C" clip retainer, but which requires special tooling to unload the spring to remove the clip and faucet. U.S. Pat. No. 5,515,882 discloses another spring-biased fastener that provides initial faucet retention, but depends on a threaded fastener to compress the fastener and draw the faucet tight to the sink.

The present invention was developed to provide a spring-biased faucet retainer that during installation resiliently self-grips the lower surface of a sink without operator intervention and draws the faucet to engage the sink. During faucet removal, the retainer can be manually manipulated to release spring-biased gripping members without special tooling. The retainer includes members that can be manually gripped and compressed, without having to view the retainer, to release the faucet for repair or replacement. The members are normally biased to an expanded condition and flex during mounting to secure the faucet once positioned on the sink. One retainer assembly provides axially directed latch and retractor pieces that are captured and biased relative to a housing and are operative to direct gripping surfaces to grip the sink. Another retainer assembly provides hinged gripper pieces having contoured gripping surfaces that are spring biased relative to each other and that pivot at a supporting housing. Another retainer assembly provides resilient, deformable leaf spring arms having contoured gripping surfaces.

SUMMARY OF THE INVENTION

It is accordingly a primary object of the invention to provide a resilient, spring-biased faucet retainer system that self-mounts and releases the faucet from a sink without tools.

It is a further object of the invention to provide a spring-biased retainer that is adaptable to a faucet base and is normally biased to self-expand and secure the faucet to the sink as the retainer is extended through mounting apertures.

It is a further object of the invention to provide a spring-biased retainer that is adaptable to a faucet base and can be manipulated in cramped spaces by hand to release the faucet from a sink.

It is a further object of the invention to provide a retainer having at least one spring biased gripper piece and means to overcome a normal condition and direct gripping surfaces to either release or induce gripping.

It is a further object of the invention to provide a retainer having a housing containing one gripping surface and bound spring biased gripper and retractor pieces with tapered surfaces that cooperate with axial movement to extend and retract another gripping surface at the gripper member.

It is a further object of the invention to provide a retainer having a housing that contains one or more hinged gripper members having contoured gripping surfaces that are spring-biased relative to each other to rotate and project from the housing.

It is a further object of the invention to provide posts having tapered surfaces that extend from a faucet base and cooperate with at least one spring biased retainer at each faucet to optimize gripping and prevent rotational movement of the faucet, once mounted.

It is a further object of the invention to provide a deformable resilient retainer with at least one arm that compresses and flexes to direct a contoured gripper surface relative to a sink.

The foregoing objects, advantages and distinctions of the invention, among others, are obtained in several spring-biased retainer assemblies shown in association to a typical faucet. The base of each faucet is modified to include at least one spring-biased retainer that aligns with a mounting aperture at a support (e.g. a sink). The retainer self-compresses during insertion to facilitate faucet mounting. Once inserted, at least one spring biased member expands to a latched condition to secure the faucet to the sink. Faucet release is achieved by manually compressing the resiliently biased retainer piece(s) and raising the faucet.

One disclosed retainer includes a housing that is secured to the faucet base and has a first gripping surface that grips an edge of a through hole in the sink. Gripper and retractor pieces having overlapping inclined slide surfaces cooperate with an inclined housing surface and are biased for reciprocating movement to direct a contoured gripping surface at the gripper piece to engage the sink, such that the faucet is drawn into compression with the sink. Springs fitted to the gripper and retractor pieces abut the housing and cooperate with the inclined housing surface to maintain compression. A retainer pin secures the retractor piece to the housing and a catch arm extends from the retractor piece to engage the gripper piece and effect release.

Posts having tapered surfaces can optionally be mounted to project from the faucet base and cooperate with one or more gripping surfaces at the spring-biased retainers. The posts can be secured to the faucet with threads, deformable rivet-like surfaces, an adhesive or a variety of other fasteners.

Another disclosed retainer includes a pair of gripper pieces that are biased to pivot from a housing in repelling relation. Each gripper has a gripping surface that is contoured (e.g. tapered, arcuate, elliptic and/or with lateral flaring) to promote faucet compression and prevent faucet movement. The gripper pieces are recessed and retained with hinge pins to the housing at pivot sockets. The sockets define rotation limits.

Another resilient retainer provides at least one deformable, resilient leaf spring arm that is biased in repulsion to another arm. The deformable retainer arm has a contoured gripping surface that draws the faucet into engagement with the sink and prevents faucet movement.

A variety of modifications and improvements are also disclosed that can be adapted to the present retainers and faucets outfitted with the retainers and/or posts.

Still other objects, advantages, distinctions and constructions of the invention will become more apparent from the following description with respect to the appended drawings. Similar components and assemblies are referred to in the various drawings with similar alphanumeric reference characters. Various features of the invention may also be configured with other features in different combinations. The description should therefore not be literally construed in limitation of the invention. Rather, the invention should be interpreted within the broad scope of the further appended claims.

DESCRIPTION OF THE PREFERRED EMBODIMENT

Figure 1:
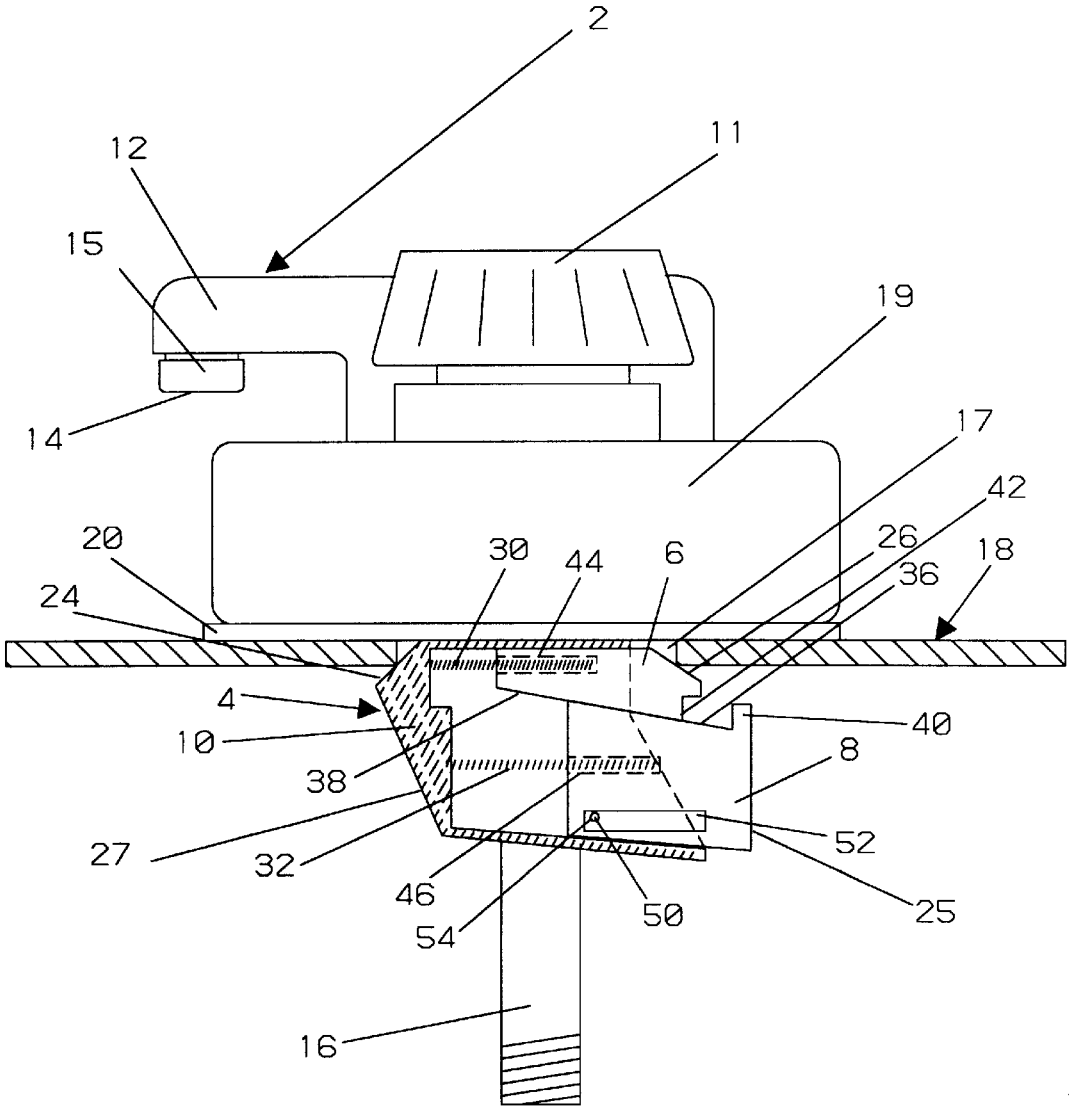
FIG. 1 shows a side view of a typical faucet mounted to a sink shown in cross section view with a resiliently biased retainer of the invention that is shown in cross section and that is expanded to a latched condition.
Figure 2:
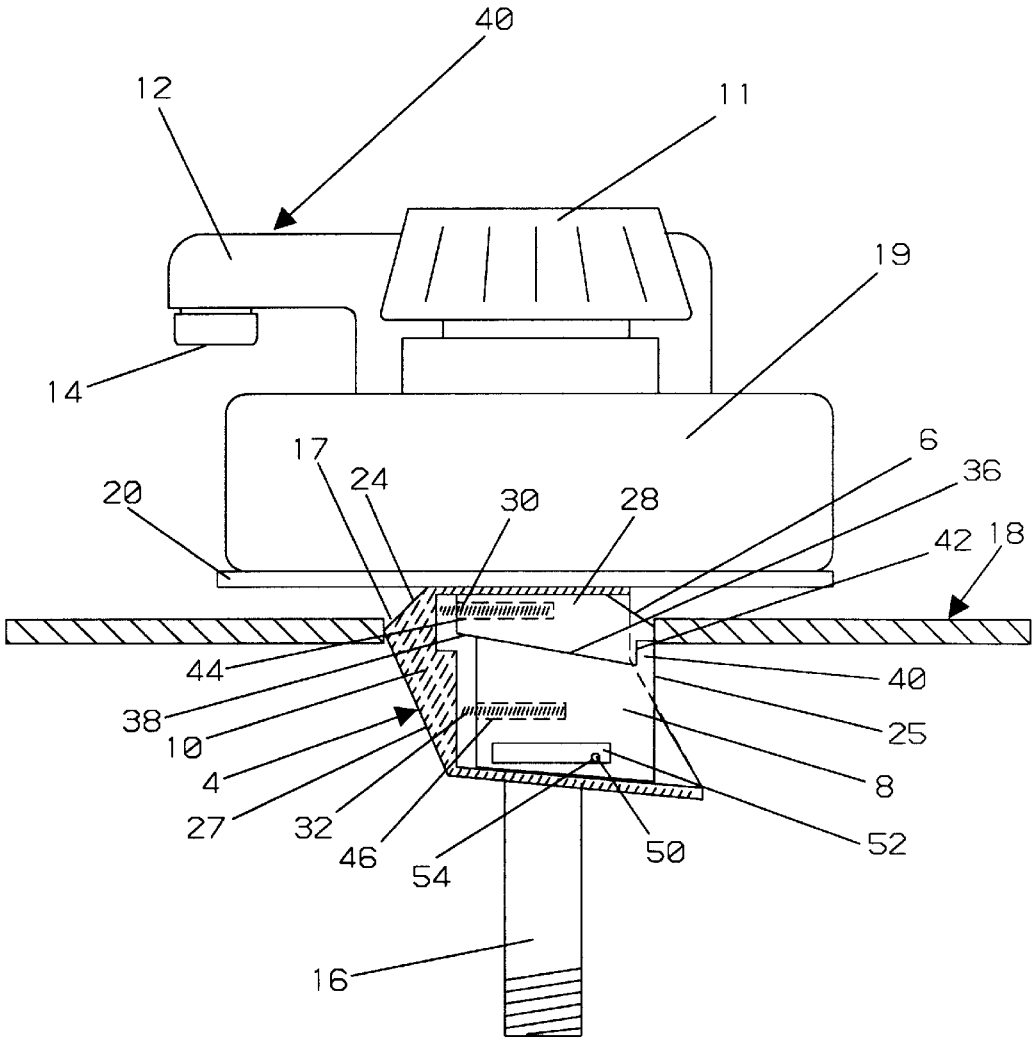
FIG. 2 shows a side view of the faucet of FIG. 1 with the gripper and retractor pieces contracted to a mounting condition and wherein the retainer can be fit through a mounting aperture.

Referring to FIGS. 1 through 6 drawings are shown to an improved faucet 2 that typically includes a pair of spring biased retainer assemblies 4, but only one of which assemblies 4 is shown. FIG. 1 shows one of the retainer assemblies 4 in side profile and partial cross section with a gripper piece or member 6 expanded to engage a sink that is also shown in cross section. FIG. 2 shows the retainer assembly 4 with the gripper piece 6 retracted via a retractor member 8. FIGS. 3 through 6 show details to a retainer housing 10, the gripper and retractor members 6 and 8 and the relative mountings of the components of the retainer assembly 4.

The retainers 4 are adaptable to faucets 2 of any conventional style and type. A typical faucet 2 includes hot and cold handles 11, a neck 12, and a spout 14 that may have an attached aerator 15. Some faucets 2 provide a single flow control handle 11 and associated control valve. Water supply lines 16 depend from a base 19 and typically extend through available apertures 17 provided at a mating support, which typically is a sink 18. Depending upon the faucet type, the retainers 4 can be positioned to mount to any available aperture 17. A compressible seal 20 of a suitable thickness can be mounted between the faucet 2 and sink 18. Alternatively, deformable putty can be used to seal the interface between the sink 18 and faucet 2 to prevent seepage from the sink top through any apertures 17.

Typically, two retainers 4 depend from each faucet 2. For a typical two handle faucet 2, one retainer 4 is mounted adjacent each of two available water supply lines 16, reference FIG. 1. A retainer housing 10 is typically formed as part of or is secured to the faucet base 19. The housing 10 can be constructed of plastic or a formed metal. The dimensions and shape of the housing 10 and gripper and retractor members 6 and 8 can be adjusted to accommodate mounting apertures 17, which nominally are found in the range of 1 to 6 inch diameters. The retainer 4 can also depend from the compressible seal 20, assuming the seal 20 is separately attached to the faucet 2.

The housing 10 includes a gripper surface 24 and the spring-biased gripper member 6 includes a cooperating, contoured gripping surface 26. The shapes of the gripping surfaces 24 and 26 are formed to promote compression of the faucet 2 into the sink 18. The contour of the surfaces 24 and 26 (e.g. tapered, arcuate, elliptic and/or with lateral flaring) can be varied as desired to accommodate each particular retainer assembly 4.

Figure 3:
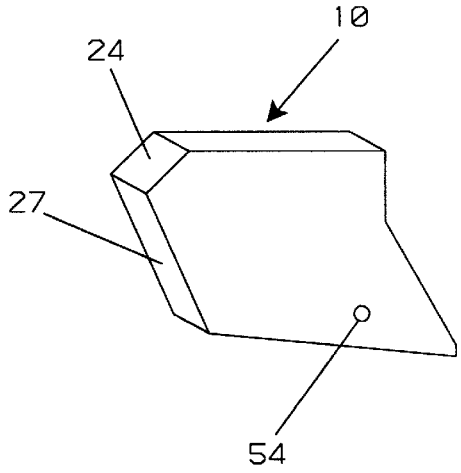
FIG. 3 is a perspective drawing of the retainer housing showing a tapered gripping surface and an inclined lower surface that secures against retainer release.
Figure 4:
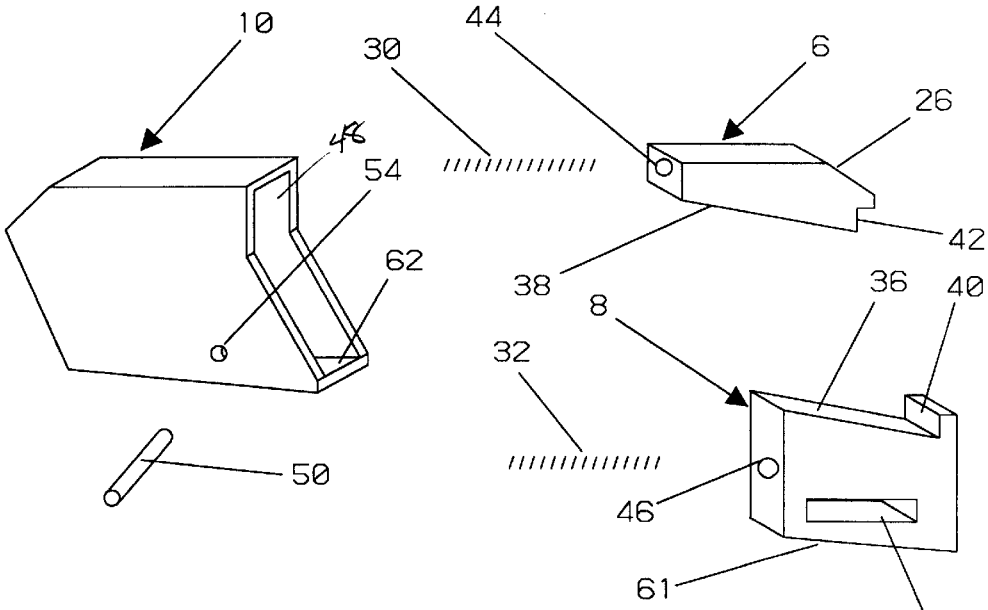
FIG. 4 is a perspective-drawing shown in exploded assembly to the retainer housing rotated to expose an internal chamber that contains gripper and retractor members, along with biasing springs and a keeper pin.
Figure 5:
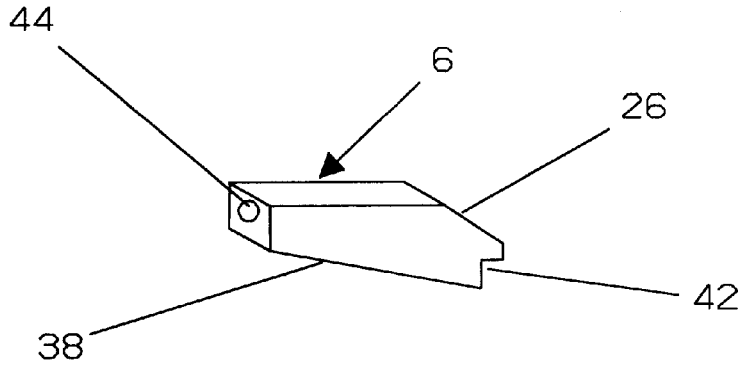
FIG. 5 shows the gripper member of the retainer of FIG. 1.
Figure 6:
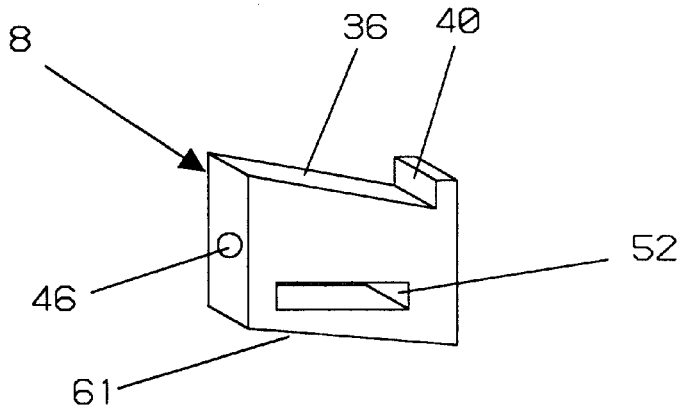
FIG. 6 shows the retractor member of the retainer of FIG. 1.

During faucet mounting and with attention to FIGS. 2, 3 and 4, the spring-biased gripper and retractor members 6 and 8 are manipulated by the installer to a mounting condition wherein the distance between gripping surfaces 24 and 26 permits the mounting of each retainer 4 through one of the apertures 17. That is, as the retainer 4 and supply line 16 are inserted through the holes 17 with the housing 10 tipped, the aft surface 25 of the retractor member 8 is compressed inward of the housing 10 to engage and compress the gripper member 6. Both member 6 and 8 self-compress into the housing 10 until the gripping surfaces 24 and 26 pass through the aperture 17. Once the gripping surfaces 24 and 26 pass through the aperture 17, the retractor and gripper members 8 and 6 are biased outward and the gripping surfaces 24 and 26 are displaced into contact with the bottom of the sink 18 and a retention condition, reference FIG. 1, wherein portions of the surfaces 24 and 26 contact the edges of the aperture 17 and other portions extend diametrically beyond the aperture 17.

As mentioned, the contours of the gripping surfaces 24 and 26 exhibit contoured shapes that promote compression of the faucet 2 into the sink 18 and a wedging action. A variety of contoured shapes may be employed to this end.

Preferably, the faucet 2 is held by the retainer(s) 4 so that the faucet 2 cannot move laterally, rotate etc. Over time and with the seating of the faucet 2 and attachment of the plumbing connections the faucet mounting position is sustained against normal use and abuse. The shape of the apertures 17 and/or holes in the seal 20 can also be adapted to the shape of the housing 10 to minimize faucet movement, once mounted and seated.

Returning attention to FIG. 1, spiral wound springs 30 and 32 abut the interior of the housing 10 and bias the gripping surfaces 24 and 26 into contact with the sink 18. The springs 30 and 32 extend from the gripper member 6 and the retractor member 8 and generally extend parallel to the base of the sink 18. Depending upon the shapes and mounting positions of the members 6 and 8, the springs 30 and 32 can be positioned to direct biasing forces in any desired direction. The contour of the gripping surfaces 24 and 26 in cooperation with the axial displacement of the gripper member 6 and a retractor member 8 via the springs 30 and 32 draws the faucet 2 into the sink 18, yet prevents the withdrawal of the retainers 4 and supply lines 16 through the holes 17. Withdrawal can be achieved only by manually compressing the retractor member 8.

The springs 30 and 32 can take a variety of forms besides the depicted wound form. For example and without limitation, one or both springs 30 and 32 can be constructed as leaf or torsion springs. The gripper and retractor members 6 and 8 can also be constructed of deformable and/or resilient materials whereby a spring-biased action is obtained with an appropriate shaping and placement of surfaces of the gripper and retractor members 6 and 8 relative to each other and/or the housing 10.

As shown in FIGS. 1 and 2, the gripper and retractor members 6 and 8 are mounted to slide over each other at cooperating inclined surfaces as the retractor member 8 slides over an inclined bottom surface 62 of the housing 10. The axial cooperation vertically expands and contracts the combined height of the members 6 and 8 to promote faucet compression and prevent creeping of the retractor member 8, once the faucet 2 is mounted. Once the faucet 2 is seated, the spring 32 and incline 62 discourage creeping of the retractor member 8.

Details to foregoing and the construction of the housing 10 and the gripper and retractor members 6 and 8 are depicted at FIGS. 3–6. The slide action occurs at overlapping tapered or inclined surfaces 36 and 38 at the gripper and retractor members 6 and 8 and the inclined interior surface 62 at the housing 10. Upon axially directing the retractor member 8 inward of the housing 10 by pushing on the surface 25, a catch arm 40 contacts a notch 42 at the gripper member 6 to compress the gripper member 6 into the housing 10. The gripping surface 26 is eventually disengaged from the sink 18, if previously engaged. The springs 30 and 32 are contained in bores 44 and 46 and normally bias the gripper and retractor members 6 and 8 to the extended or retention condition. This condition is further sustained due to the declination of the surfaces 36, 38 and 62.

The gripper and retractor members 6 and 8 are retained in an interior cavity 48 of the housing 10 via a keeper pin 50 that extends through a slot 52 in the retractor member 8 and between holes 54 in the sidewalls of the housing 10.

Although an axial sliding cooperation is shown between the gripper and retractor members 6 and 8, the shapes and mounting orientations of the members 6 and 8 and cooperating surfaces 36 and 38 can be varied as desired. For example, the housing 10 and members 6 and 8 can be modified such that a portion of the retractor member 8 extends through the bottom of the housing 10 and a longitudinal pushing motion directed parallel to the supply line 16 manipulates the gripper member 6 along an orthogonal axis. Such an arrangement facilitates detachment of a faucet 2, due to the applied pushing force on the retractor member 8, which can be performed more easily when lying on one's back in the cramped spaces of a sink cabinet.

Figure 7:
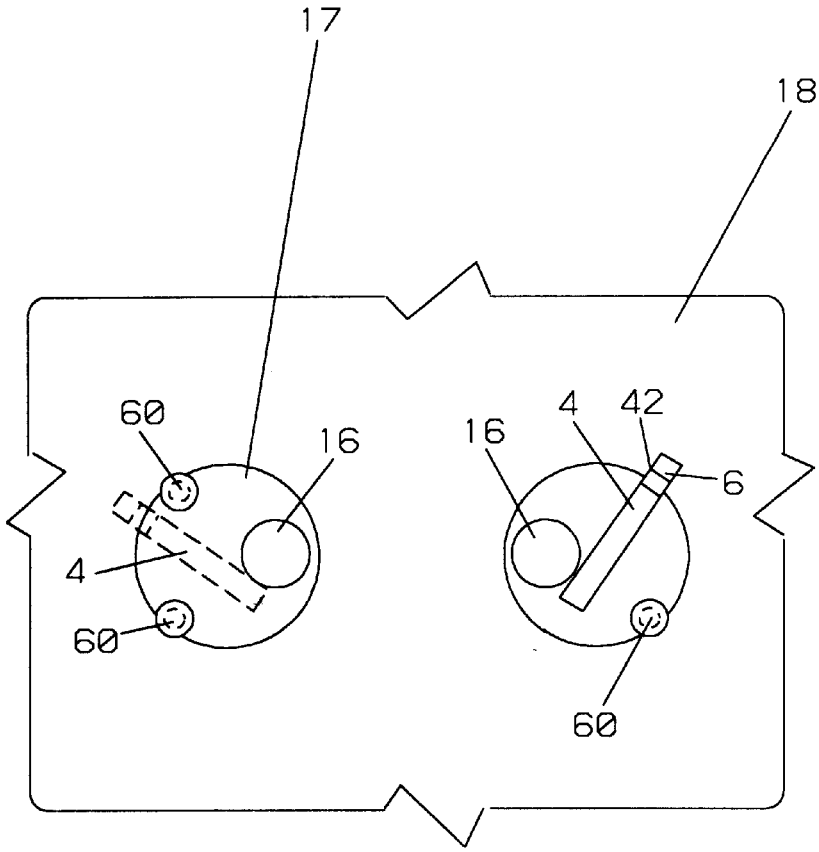
FIG. 7 shows a bottom view of a typical sink relative to one or more spring-biased retainers and several tapered wedging posts to cooperate to secure the faucet to the sink.
Figure 8:
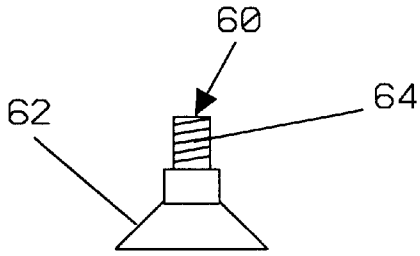
FIG. 8 shows a side view to a threaded wedge post.

FIGS. 7 and 8 disclose an alternative mounting arrangement of a faucet 2 containing one or more of the retainer assemblies 4 that cooperate with a number of tapered posts 60. The posts 60 cooperate with any provided retainer 4 to obtain a wedging action that discourages faucet movement.

FIG. 7 depicts an exemplary mounting wherein a faucet 2 is shown as it appears when looking toward the bottom of the sink 18 and through the apertures 17. The depicted arrangement requires only one retainer 4 and several wedging posts 60 that are shown in FIG. 8. Several posts 60 are mounted in the left aperture 17 and the single retainer 4 and a post 60 are mounted in the right aperture. The tapered surfaces 62 of the posts 60 are arranged to extend through and engage the edges of the hole 17. This contact in combination with the compressive action of the retainer 4 prevents faucet movement.

The posts 60 can be secured to the faucet base 19 with threads 64. Alternatively, the threaded surface 64 can be constructed as a deformable stud or an adhesive can be used to retain the posts 60. The posts 60 can also be cast as part of the base 19.

Positioning two posts 60 in one aperture 17 and one post 60 and a retainer assembly 4 in the other aperture 17 as depicted has been found to provide adequate retention with a single retainer assembly 4. However, a second retainer assembly 4, shown in dashed line at FIG. 7, can also be provided as desired at the other aperture 17.

Figure 9:
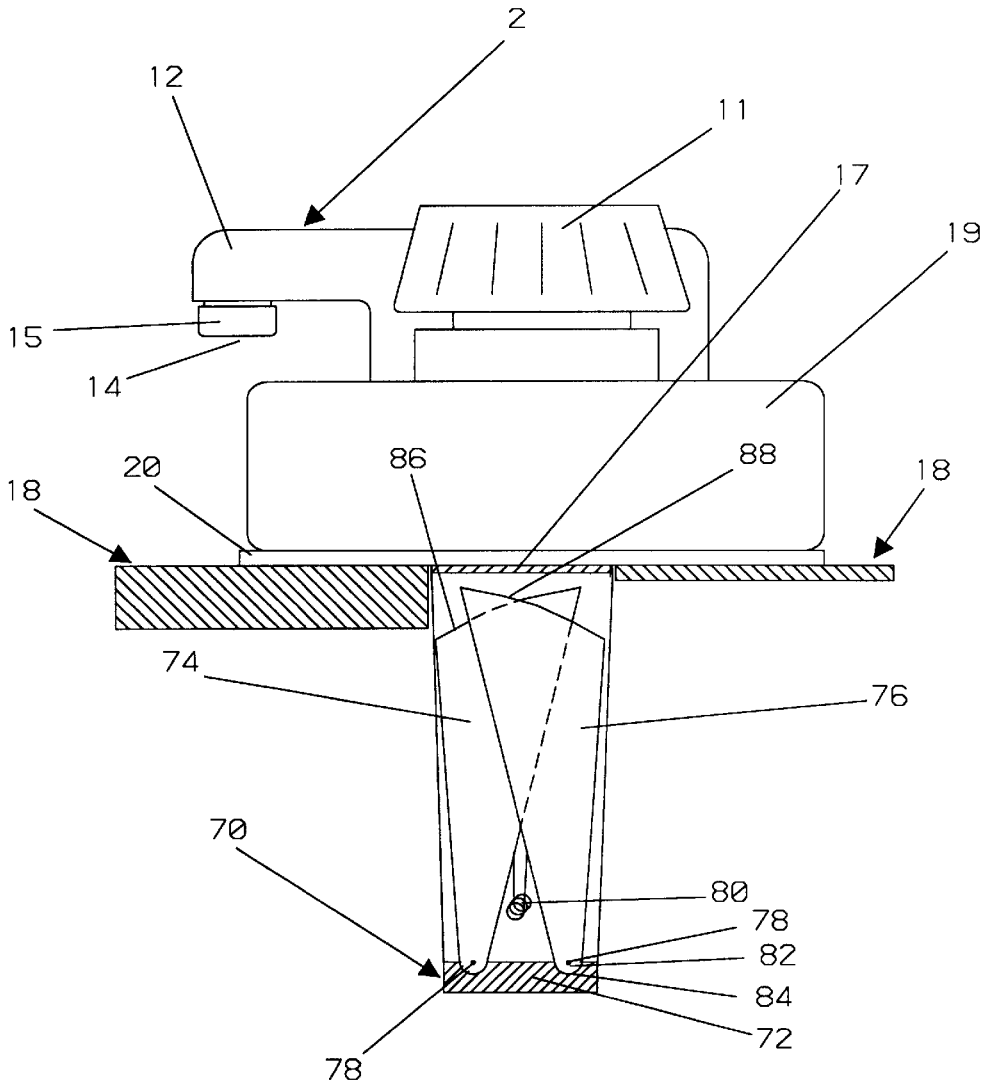
FIG. 9 shows a side view of a typical faucet mounted to sinks of alternative thickness that are shown in cross section with a retainer having a pair of gripper members that are biased in repelling relation at a supporting housing and wherein the grippers are shown compressed such as during faucet mounting or to effect faucet release.
Figure 10:
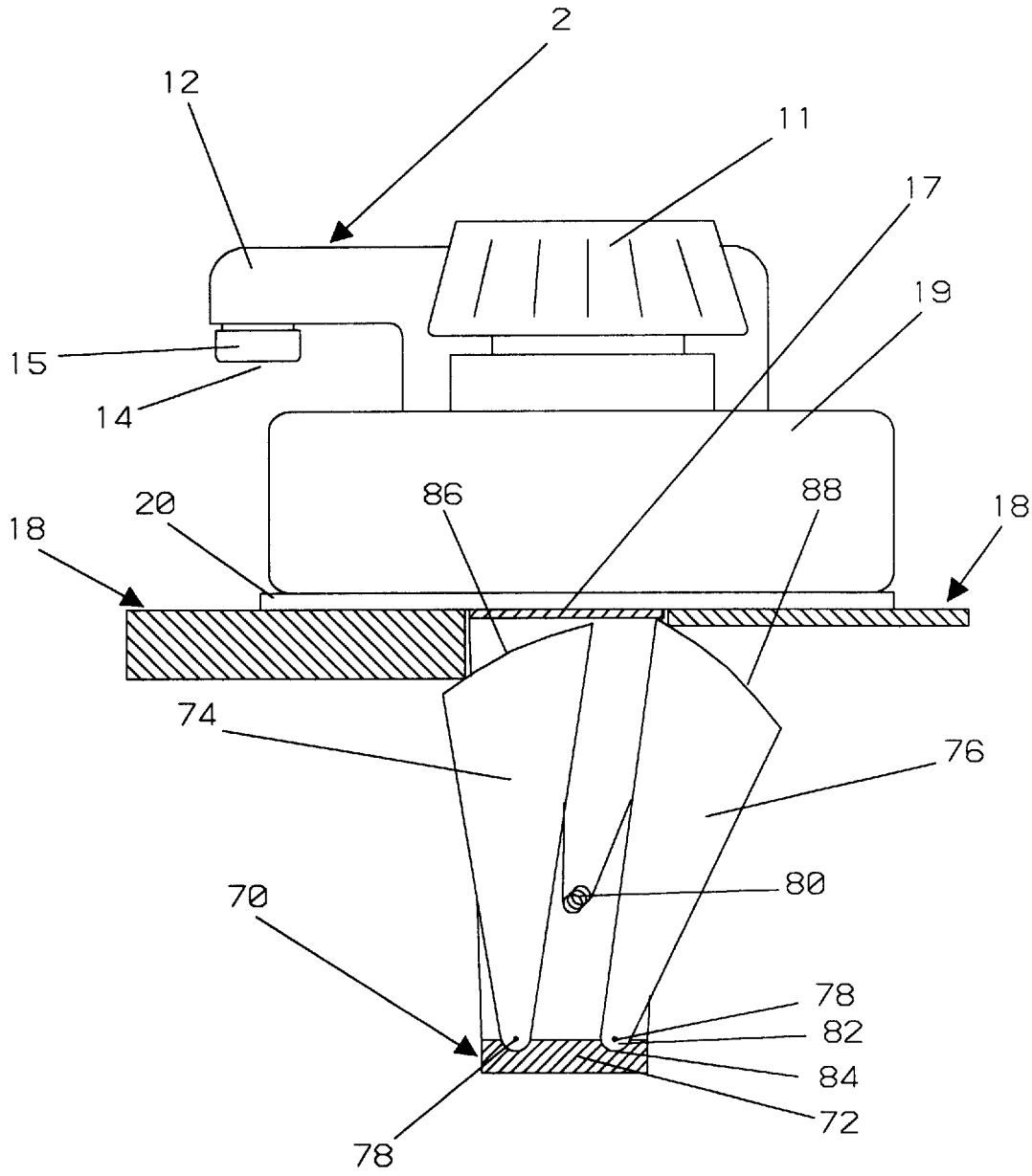
FIG. 10 shows the gripper members of the retainer of FIG. 9 expanded to a retention condition.

FIGS. 9 and 10 show another alternative, spring-biased retainer assembly 70 and which is shown in relation to sinks 18 of different thickness. The retainer 70 includes a housing 72 that is secured to the faucet base 19. Pivot arms 74 and 76 are secured to the housing 72 with hinge pins 78. A spring 80 secured between the arms 74 and 76 normally biases the arms 74 and 76 apart to the retention condition. During faucet mounting, the arms 74 and 76 rotate inward and overlap one another as shown at FIG. 9. Once the housing 72 and arms 74 and 76 are extended past the aperture 17, the arms 74 and 76 are biased to pivot outward and contact the sink 18.

An apex 82 of each arm 74 and 76 is recessed into a socket 84 of the housing 72. The edges of the sockets 84 cooperate with the pins 78 and are shaped to limit the rotation of the arms 74 and 76. Appropriately shaped contoured surfaces 86 and 88 at the arms 74 and 76 contact the edges of the holes 17 and sink 18 to promote gripping and faucet retention by compressively drawing the faucet 2 into the sink 18.

Figure 11:
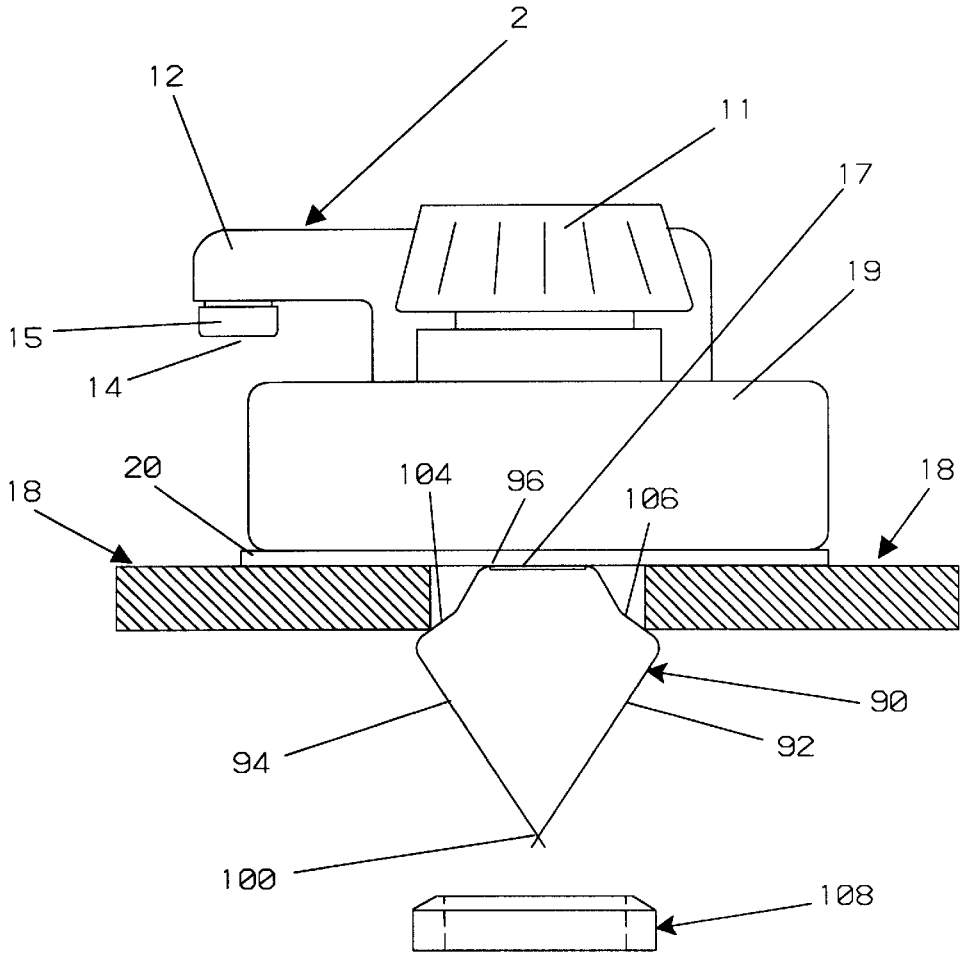
FIG. 11 shows a side view of a typical faucet mounted to a sink, shown in cross section, and relative to an optional spacer ring, shown in exploded assembly, that can be used with a retainer assembly having at least one resilient, deformable, leaf spring arm and that provides contoured gripping surfaces.

FIG. 11 discloses yet another retainer assembly 90 that is mounted to a faucet base 19. The retainer 90 includes arms 92 and 94 that depend from a flange 96 that is secured to the faucet base 19 with appropriate fasteners. The retainer arms 92 and 94 are formed of a resilient, deformable material that flexes yet returns to shape, for example a spring steel or resilient plastic.

Contoured gripping surfaces 104 and 106 are formed in the fashion of the various disclosed gripping surfaces 24 and 26 and 86 and 88 to obtain a compressive retention with a sink base 19 when the retainer 90 is inserted through an aperture 17. The arms 92 and 94 flex inward during mounting and spring outward once extended past the bottom edges of the apertures 17 to secure the faucet 2. No separate fastener is required to maintain the retention forces and prevent faucet movement. Faucet release is obtained only upon squeezing the arms 92 and 94 together sufficiently to a diameter less than the apertures 17.

Although both arms 92 and 94 are presently constructed of a deformable metal, it is necessary that only one of the arms 92 or 94 be deformable. The other arm 92 or 94 can provide a rigid surface, in the fashion of the housing 22. The retainer 90 can also be constructed as a single piece with the arms 92 and 94 joined at the apex 102. Interlocking tabs and slots can also be provided at the apex 100 of the arms 92 and 94. A spacer or washer 108 of suitable thickness is also shown in exploded assembly that can be mounted to the aperture 17 of bottom of the sink 18 to assure a sufficient compressive, faucet retention force is obtained.

While the invention has been described with respect to a preferred construction and considered improvements or alternatives thereto, still other constructions may be suggested to those skilled in the art. Several of the disclosed features can also be used independently and/or combined in different combinations. For example, the positioning of the faucet 2 can also be directed by controlling the relative shapes of the housings 10, 72 and/or seal 20 or by including other indexing pieces, such as shaped washers. Tapered or keyed surfaces can be provided to promote a preferred orientation and/or prevent faucet movement, such as achieved with the posts 60. The foregoing description should therefore not be literally construed and should instead be construed to include all those embodiments within the spirit and scope of the following claims.

What is claimed is:

1. A retainer assembly for connecting a water faucet having flow control means and water supply lines to a sink, comprising:

a) a housing rigidly mounted to said faucet;

b) a gripper member and a retractor member mounted to said housing, wherein said gripper member includes a first gripping surface shaped to grip the underside of said sink, wherein said retractor member is coupled such that manipulation of said retractor member directs the displacement of said gripper member relative to said housing between a retention condition, where the first gripping surface is displaced from said housing to contact said sink and draw said faucet into compression therewith, and a retracted condition, where the first gripping surface is retracted relative to said housing such that said retainer assembly can be inserted through a mounting aperture in said sink; and c) means for resiliently biasing said gripper and retractor members.

2. A retainer assembly as set forth in claim 1 wherein said housing includes a second gripping surface shaped to grip the underside of said sink.

3. A retainer assembly as set forth in claim 1 wherein said gripper and retractor members and said housing include cooperating tapered surfaces that interact to induce reciprocating movement relative to one another and the depression and elevation of said gripping surface as said gripper member moves between said retracted and retention conditions.

4. A retainer assembly as set forth in claim 1 wherein a keeper extends from said housing and interconnects with an elongated slot at said retractor member and wherein linear motion of said retractor member is limited by said slot.

5. A retainer assembly as set forth in claim 1 wherein a catch arm projects from said retractor member to contact and direct movement of said gripper member.

6. A faucet assembly as set forth in claim 1 including a post projecting from said faucet and having a tapered surface that abuts said mounting aperture when said gripper member is extended to said retention condition.

7. A faucet assembly as set forth in claim 1 wherein the biasing means comprises first and second springs.

8. A retainer assembly for connecting a water faucet having flow control means and water supply lines to a sink, comprising:

a) a housing adapted to mount to a faucet and having an open cavity and a first gripping surface shaped to grip the underside of said sink;

b) a gripper member and a retractor member mounted within said cavity, wherein said gripper member includes a second gripping surface shaped to grip the underside of said sink, wherein said retractor member is mounted to direct movement of said gripper member between a retention condition, where said first gripping surface is displaced such that said first and second gripping surfaces draw said faucet into compression with said sink, and a retracted condition, where the displacement between said first and second gripping surfaces is such that said retainer can be inserted through a mounting aperture in said sink; and c) spring means contacting said housing for biasing relative movement of said gripper and retractor members.

9. A retainer assembly as set forth in claim 8 wherein a keeper extends from said housing and interconnects with a slot at said retractor member and wherein a catch arm projects from said retractor member to contact said gripper member as said retractor member is compressed into said cavity to direct movement of said gripper member.

10. A retainer assembly as set forth in claim 8 wherein said spring means comprises first and second springs mounted to respectively extend from said housing and contact said gripper and retractor members.

11. A retainer assembly as set forth in claim 8 wherein first and second springs respectively bias said gripper and retractor members relative to said housing and wherein said gripper and retractor members include complementary tapered surfaces that cooperate with each other to depress or elevate the first gripping surface as said retractor member directs said gripper member between said retracted and retention conditions.

12. A retainer assembly for connecting a water faucet having flow control means and water supply lines to a sink, comprising:

a) a housing adapted to mount to said faucet, wherein said housing includes a first gripping surface shaped to grip the underside of said sink;

b) a gripper member and a retractor member mounted to said housing, wherein said gripper member includes a second surface shaped to grip the underside of said sink, wherein said retractor member is coupled to direct the displacement of said gripper member relative to said housing between a retention condition, where the second gripping surface is displaced from said housing to contact said sink, and a retracted condition, where the second gripping surface is retracted such that said retainer assembly can be inserted through a mounting aperture in said sink, wherein said gripper and retractor members are mounted for reciprocating movement relative to one another and wherein at said retention condition said first and second gripping surfaces engage the bottom surface of said sink and draw said faucet into compression therewith; and c) means for resiliently biasing said gripper and retractor members.

13. A retainer assembly for connecting a water faucet having flow control means and water supply lines to a sink, comprising:

a) a housing adapted to mount to said faucet;

b) a gripper member and a retractor member mounted to said housing, wherein said gripper member includes a gripping surface shaped to grip the underside of said sink, wherein a catch arm projects from said retractor member to contact and direct movement of said gripper member as said retractor member is retracted relative to said housing between a retention condition, where the gripping surface is displaced from said housing to contact said sink and draw said faucet into compression therewith, and a retracted condition, where the gripping surface is retracted such that said retainer assembly can be inserted through a mounting aperture in said sink, and wherein; and c) means for resiliently biasing said gripper and retractor members.

14. A faucet assembly having flow control means, water supply lines and retainer means for coupling to a sink, wherein said retainer means comprises:

a) a housing having an open cavity;

b) a gripper member and a retractor member mounted within said cavity, wherein said gripper member includes a gripping surface shaped to grip the underside of said sink, wherein said retractor member is coupled to direct movement of said gripper member between a retention condition, where the gripping surface is displaced relative to said housing to contact said sink and draw said faucet into compression therewith, and a retracted condition, where the gripping surface is retracted relative to said housing such that said retainer can be inserted through a mounting aperture in said sink; and c) first and second springs respectively biasing said gripper and retractor members relative to said housing and wherein said gripper and retractor members include tapered surfaces that cooperate with each other to depress and elevate the gripping surface as said retractor member directs said gripper member between said retracted and retention conditions.

15. A faucet assembly having flow control means, water supply lines and retainer means for coupling to a sink, wherein said retainer means comprises:

a) a housing having an open cavity;

b) a gripper member and a retractor member mounted within said cavity, wherein said gripper member includes a gripping surface shaped to grip the underside of said sink, wherein said retractor member is coupled to direct movement of said gripper member between a retention condition, where the gripping surface is displaced relative to said housing to contact said sink and draw said faucet into compression therewith, and a retracted condition, where the gripping surface is retracted relative to said housing such that said retainer can be inserted through a mounting aperture in said sink;

c) a post projecting from a faucet base and having a tapered surface that abuts said mounting aperture when said gripper member is displaced to said retention condition; and d) means for resiliently biasing the relative movement of said gripper and retractor members.

16. A retainer assembly for connecting a water faucet having flow control means and water supply lines to a sink, comprising:

a) a housing rigidly mounted to said faucet;

b) a gripper member and a retractor member mounted to said housing, wherein said gripper member includes a gripping surface shaped to grip said sink, wherein said retractor member is coupled such that manipulation of said retractor member directs the displacement of said gripper member relative to said housing between a retention condition, where the gripping surface is displaced from said housing to contact said sink and draw said faucet into compression therewith, and a retracted condition, where the gripping surface is retracted relative to said housing such that said retainer assembly can be inserted through a mounting aperture in said sink; and c) first and second resilient members respectively coupled between said housing and one of said gripper and retractor members to independently bias the movement of each of said gripper and retractor members.

17. A retainer assembly for connecting an appliance to an aperture at a planar support, comprising:

a) a housing rigidly mounted to said appliance and having an open cavity;

b) a gripper member and a retractor member mounted within said cavity, wherein said gripper member includes a gripping surface shaped to grip said support, wherein said gripper and retractor members include surfaces interconnected with each other such that manipulation of said retractor member directs said gripper member between a retention condition, where the gripping surface is displaced relative to said housing to contact said support and draw said appliance into compression therewith, and a retracted condition, where the gripping surface is retracted relative to said housing such that said retainer assembly can be inserted through a mounting aperture in said support; and c) a resilient member mounted to bias movement of said retractor member relative to said housing.

18. A retainer assembly as set forth in claim 17 wherein said housing includes a second gripping surface shaped to grip said support at said retention condition.

19. A retainer assembly as set forth in claim 17 including first and second springs mounted to independently bias the respective movement of said gripper and retractor members relative to each other and to said housing.

20. A retainer assembly as set forth in claim 17 wherein a keeper extends from said housing and interconnects with an elongated slot in said retractor member and wherein motion of said retractor member is limited by the length of said slot.

21. A retainer assembly as set forth in claim 17 wherein a catch arm projects from said retractor member to contact and direct movement of said gripper member.

* * * * *